United States Patent [19]

Safranski

[11] Patent Number: 5,002,220

[45] Date of Patent: Mar. 26, 1991

[54] ADHESIVE CLOSURE FLAP WITH PROTECTIVE LINER AND DETACHABLE TAB

[75] Inventor: Richard L. Safranski, Corbett, Oreg.

[73] Assignee: Manufacturing Concepts, Inc., Portland, Oreg.

[21] Appl. No.: 422,889

[22] Filed: Oct. 18, 1989

[51] Int. Cl.[5] ..... B65D 27/16

[52] U.S. Cl. ..... 229/80; 229/136; 493/150

[58] Field of Search ..... 229/80, 136; 206/632, 206/633; 493/264, 150, 214, 220, 223, 239, 63, 62, 74, 82

[56] References Cited

U.S. PATENT DOCUMENTS

| | | | |
|---|---|---|---|
| 1,944,020 | 1/1934 | Vogel | 229/80 |
| 2,251,930 | 8/1941 | Gray | 493/220 |
| 2,895,534 | 7/1959 | Steidinger | 493/214 |
| 2,962,205 | 11/1960 | McFarland | 229/80 |
| 2,998,180 | 8/1961 | Dehoney, Jr. | 229/136 |
| 3,026,018 | 3/1962 | Stratton et al. | 229/80 |
| 3,070,280 | 12/1962 | Richmond | 229/80 |
| 3,265,289 | 8/1966 | Hiersteiner | 229/80 |
| 3,272,095 | 9/1966 | Heuff | 493/239 |
| 3,372,861 | 3/1968 | Johnson et al. . | |
| 4,612,006 | 9/1986 | Tokuno | 493/82 |
| 4,726,804 | 2/1988 | Stitcher | 493/223 |

FOREIGN PATENT DOCUMENTS

| | | | |
|---|---|---|---|
| 2439101 | 5/1975 | Fed. Rep. of Germany | 229/80 |
| 693972 | 7/1953 | United Kingdom | 229/80 |

*Primary Examiner*—Stephen P. Garbe

*Attorney, Agent, or Firm*—Chernoff, Vilhauer, McClung & Stenzel

[57] ABSTRACT

An envelope closure having a flap with a detachable tab. Adhesive transfer tape is applied to the flap and tab, thus enabling adhesive and a protective liner to be applied in a single step. The tab may be separated from the flap, providing a convenient handhold for removing the protective liner.

1 Claim, 1 Drawing Sheet

ADHESIVE CLOSURE FLAP WITH PROTECTIVE LINER AND DETACHABLE TAB

BACKGROUND OF THE INVENTION

The present invention relates to a closure for a container, such as an envelope, box, or carton, and the process of constructing the closure. More specifically, the invention pertains to a closure employing a preapplied adhesive covered by a removable protective liner.

Many types of containers, such as envelopes and boxes, are sealed with adhesive closures. For convenience, the adhesive is usually preapplied to either a movable flap, or the body of the container where the flap contacts, eliminating the need for tape or glue. Typically, such preapplied adhesive is protected from inadvertent contact by a protective liner covering the adhesive.

Johnson et al. U.S. Pat. No. 3,372,861 discloses an adhesive strip on an envelope flap which is covered by a protective liner. The protective liner extends beyond the edge of the flap enabling it to be easily removed. This type of closure typically requires a two-step manufacturing process of: (1) applying the adhesive to the flap; and (2) covering the adhesive with the protective liner.

Adhesive transfer tape, sometimes referred to as "glue tape," can convert this two-step manufacturing process to a single step. However, this benefit is achieved at the cost of complicating the removal of the protective liner. If the glue tape is applied extending beyond the edge of the flap, the exposed adhesive on the extended portion of the glue tape would transfer to anything with which it came in contact. Alternatively, if the glue tape is applied to a flap entirely within the flap's margins, the protective liner lacks an extended free margin to grasp—since glue tape typically has adhesive applied to the surface area of one side of the tape. To peel the protective liner from the adhesive, one of its corners must be pried up with a thin object, such as a fingernail.

What is needed then, is an improved adhesive flap closure, and a method of making the same, which may be constructed by a single-step application of both adhesive and a protective liner while providing for easy removal of the protective liner.

SUMMARY OF THE INVENTION

The present invention pertains to a closure for a container having a movable flap. The flap is secured in a closed position by a preapplied adhesive which is normally covered by a protective liner. A detachable tab is secured to a portion of the container by a frangible connection. The adhesive and protective liner are applied to the container across the frangible connection and onto the detachable tab. The tab may be detached to provide a convenient handhold for removing the protective liner. The detachable tab may be associated with the movable flap or with the body of the container.

The closure may be constructed by delimitating the detachable tab from a portion of the container with a frangible connection formed by a row of perforations or such. The adhesive and protective liner are then applied to the container across the frangible connection and onto the detachable tab. Glue tape may be used to combine the application of the adhesive and protective liner into one step.

It is therefore a principal object of the present invention to provide an improved adhesive closure.

It is another object of the present invention to provide a convenient handhold for removing a protective liner covering the adhesive.

It is a related object to provide a detachable tab for removing the protective liner, which tab is made from a normally discarded portion of the container material.

It is a specific object to form the detachable tab from the container material at the same time the container is formed.

It is a further object to provide for a process of constructing an adhesive closure wherein the adhesive and a protective liner are applied in a single step, while still providing for easy removal of the liner.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
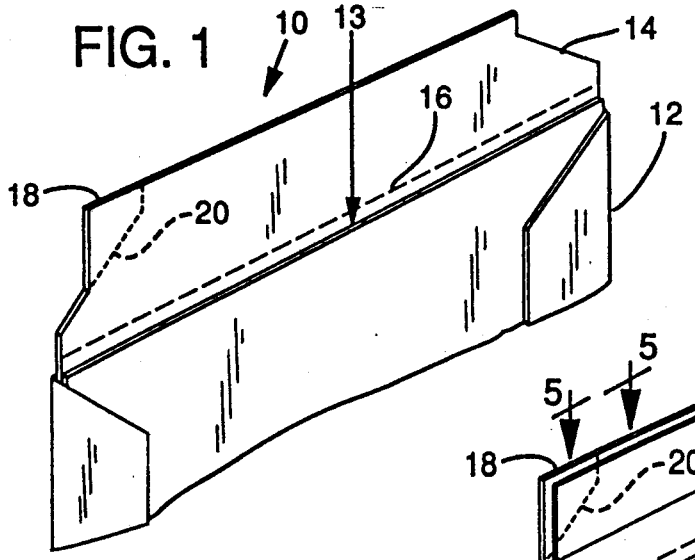
FIG. 1 is partial perspective view of an exemplary envelope having a flap with a detachable tab according to the present invention.
Figure 5:
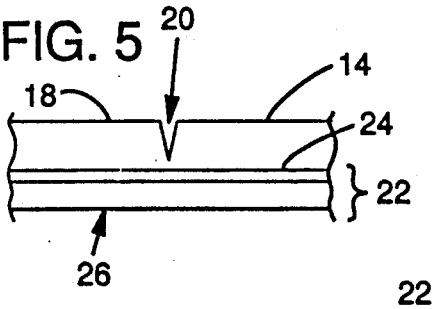
FIG. 5 is a partial top view of the tab area of the flap taken along line 5—5 of FIG. 2 showing how the flap may be scored to create a frangible connection for the tab.

Referring to the drawings, FIG. 1 shows a partial perspective view of an envelope 10 made of paperboard or the like. The envelope includes a body 12 for receiving papers or other articles. A flap 14 on the envelope is adapted to fold over the opening 13 of the envelope to close the envelope. Optionally, the flap may include a crease 16 to facilitate folding the flap along a proper line. Located at one corner of the flap is a detachable tab 18 being delimitated from the flap by a frangible connection 20, which allows the tab to be easily removed from the flap. The frangible connection may be a row of perforations, as shown in FIGS. 1–4, or alternatively as shown in FIG. 5, may be constructed by scoring nearly through the paperboard or other material which composes the flap 18 and tab 14.

Figure 2:
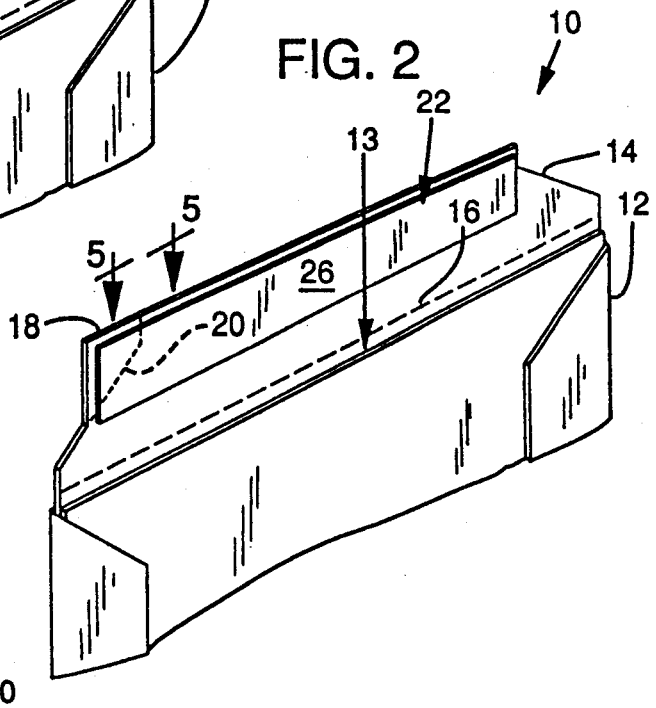
FIG. 2 is a partial perspective view of the envelope of FIG. 1 having a strip of glue tape applied to the flap and tab.

In FIG. 2, the envelope 10 is shown with a strip of adhesive transfer tape 22 or "glue tape" applied to the flap 14 and tab 18, extending across the frangible connection 20. As used herein, "glue tape" refers to nonstick protective liner material which is coated on one side with a sticky adhesive. In use, the adhesive side of the glue tape is applied to a surface, such as the exemplary envelope's flap, with the protective liner preventing the adhesive from contacting other surfaces. When the protective liner is removed, the exposed adhesive remains on the surface of the flap for fastening the flap to another surface, such as the body of the envelope.

The envelope of FIG. 2 is an exemplary embodiment of the present invention.

Figure 3:
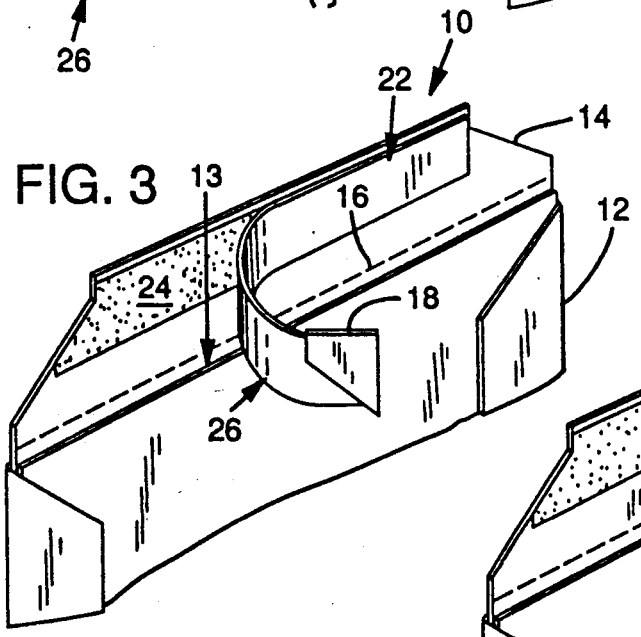
FIG. 3 is a partial perspective view of the exemplary envelope in the process of having the protective liner removed from the adhesive.
Figure 4:
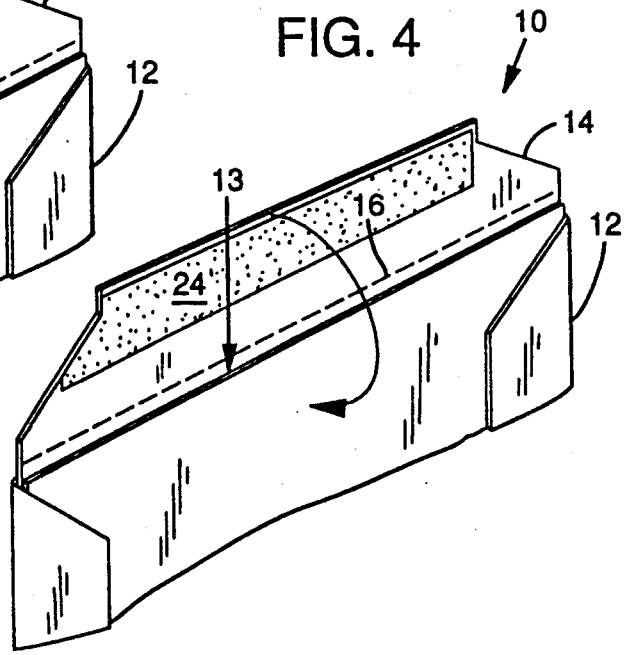
FIG. 4 is a partial perspective view of the envelope with the tab and protective strip removed.

Referring now to FIG. 3, the same envelope 10 is shown with the protective liner 26 in the process of being removed from the adhesive 24. To facilitate easy removal of the protective liner, the detachable tab 18 is separated from the flap 14 at the frangible connection 20. The protective liner remains attached to the tab 18, providing a convenient handhold for removing the protective liner from the adhesive 24 adhering to the flap. Once the protective liner has been removed, the flap may be folded along the crease 16 to overlap the body of the envelope, the exposed adhesive adhering to the body of the envelope, thereby sealing the envelope.

A closure which embodies the present invention may be made by the following steps. In the exemplary envelope, the detachable tab 18 and flap 14 are formed from a single integral sheet of material, such as thin paperboard, as shown in FIG. 1. The frangible connection 20 may be constructed at the same time that the paperboard board is cut to form the flap 14. Thus, the detachable tab is constructed as part of an existing manufacturing step out of what would normally be waste material. Glue tape 22 is then applied to both the tab and flap, across the frangible connection, as shown in FIG. 2.

Although the present invention has been described in an exemplary embodiment which uses glue tape, certain of the invention's benefits may be obtained using a two-step process of applying an adhesive to both the tab and flap across the frangible connection and then applying a protective liner over the adhesive. The adhesive need not be applied in a continuous strip. If multiple adhesive spots are applied, a single protective liner which covers adhesive spots on both the tab and flap and extends over the frangible connection is preferred.

It will be appreciated that the described closure may be used for containers other than envelopes. Any container which uses preapplied adhesive to effect a closure may utilize the disclosed invention. Thus, boxes and cartons as well as other containers using preapplied adhesive may use a closure as described herein. It should also be pointed out that the adhesive, protective liner, and detachable tab may be associated with the body of the container and need not be associated with the flap, or movable portion of the closure.

The terms and expressions which have been employed in the foregoing specification are used therein as terms of description and not of limitation, and there is no intention, in the use of such terms and expressions, of excluding equivalents of the features shown and described or portions thereof, it being recognized the scope of the invention is defined and limited only by the claims which follow.

What is claimed is:

1. A closure for a container having an opening, comprising:

(a) a flap and a fastening surface proximate said opening and movable with respect to each other to position said flap over said opening, said flap including dissimilarly-shaped opposed first and second lateral edge portions;

(b) a detachable tab integrally formed to said flap so as to define said first lateral edge portion;

(c) adhesive means applied to said flap and said tab substantially from said first lateral edge portion to said second lateral edge portion for adhering said flap to said fastening surface;

(d) a protective liner substantially covering said adhesive means on said tab and said flap, said tab serving as detachable means for removing said liner from said adhesive means that is applied to said flap; and (e) said tab being configured so that detachment of said tab from said flap creates a third lateral edge portion, in place of said first lateral edge portion, which is opposed to and similar in shape to said second lateral edge portion.

* * * * *